US011421831B2

(12) United States Patent
Lin et al.

(10) Patent No.: US 11,421,831 B2
(45) Date of Patent: Aug. 23, 2022

(54) LIGHTING APPARATUS

(71) Applicant: XIAMEN LEEDARSON LIGHTING CO., LTD, Fujian (CN)

(72) Inventors: Hongbin Lin, Fujian (CN); Weiwei Xie, Fujian (CN); Liangliang Cao, Fujian (CN); Wenchang Huang, Fujian (CN)

(73) Assignee: XIAMEN LEEDARSON LIGHTING CO., LTD, Fujian (CN)

( * ) Notice: Subject to any disclaimer, the term of this patent is extended or adjusted under 35 U.S.C. 154(b) by 0 days.

(21) Appl. No.: 17/178,910

(22) Filed: Feb. 18, 2021

(65) Prior Publication Data

US 2021/0262620 A1 Aug. 26, 2021

(30) Foreign Application Priority Data

Feb. 20, 2020 (CN) ..... 202020189985.8

(51) Int. Cl.

| | |
|---|---|
| ***F21K 9/238*** | (2016.01) |
| ***F21V 23/06*** | (2006.01) |
| ***F21K 9/232*** | (2016.01) |
| *F21Y 115/10* | (2016.01) |

(52) U.S. Cl.

CPC ..... *F21K 9/238* (2016.08); *F21K 9/232* (2016.08); *F21V 23/06* (2013.01); *F21Y 2115/10* (2016.08)

(58) Field of Classification Search

CPC ..... F21K 9/238; F21K 9/232; F21V 23/06

See application file for complete search history.

(56) References Cited

U.S. PATENT DOCUMENTS

2013/0083555 A1* 4/2013 Chen ..... F21V 5/10 362/555
2019/0195482 A1* 6/2019 Chen ..... F21V 23/005
2020/0313319 A1* 10/2020 Cao ..... H01R 4/06

FOREIGN PATENT DOCUMENTS

WO WO-2010010173 A1 * 1/2010 ..... F21V 29/89

* cited by examiner

*Primary Examiner* — Karabi Guharay
(74) *Attorney, Agent, or Firm* — Chun-Ming Shih; Lanway IPR Services

(57) ABSTRACT

A lighting apparatus includes a light source plate, a LED module, a first wire, a second wire and a terminal housing. The light source plate has a first connector and a second connector. The LED module is mounted on a first side of the light source plate to be electrically connected to the first connector and the second connector. The first wire passes through a first passage on the light source plate from a second side of the light source plate to the first side of the light source plate to engage the first connector. The second wire passes through a second passage of the light source plate from the second side of the light source plate to the first side of the light source plate to engage the second connector. The terminal housing encloses the first wire and the second wire.

17 Claims, 6 Drawing Sheets

LIGHTING APPARATUS

FIELD

The present invention is related to a lighting apparatus, and more particularly related to a light bulb device with easy assembly structure.

BACKGROUND

The time when the darkness is being lighten up by the light, human have noticed the need of lighting up this planet. Light has become one of the necessities we live with through the day and the night. During the darkness after sunset, there is no natural light, and human have been finding ways to light up the darkness with artificial light. From a torch, candles to the light we have nowadays, the use of light have been changed through decades and the development of lighting continues on.

Early human found the control of fire which is a turning point of the human history. Fire provides light to bright up the darkness that have allowed human activities to continue into the darker and colder hour of the hour after sunset. Fire gives human beings the first form of light and heat to cook food, make tools, have heat to live through cold winter and lighting to see in the dark.

Lighting is now not to be limited just for providing the light we need, but it is also for setting up the mood and atmosphere being created for an area. Proper lighting for an area needs a good combination of daylight conditions and artificial lights. There are many ways to improve lighting in a better cost and energy saving. LED lighting, a solid-state lamp that uses light-emitting diodes as the source of light, is a solution when it comes to energy-efficient lighting. LED lighting provides lower cost, energy saving and longer life span.

The major use of the light emitting diodes is for illumination. The light emitting diodes is recently used in light bulb, light strip or light tube for a longer lifetime and a lower energy consumption of the light. The light emitting diodes shows a new type of illumination which brings more convenience to our lives. Nowadays, light emitting diode light may be often seen in the market with various forms and affordable prices.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

In 1878, Thomas Edison tried to make a usable light bulb after experimenting different materials. In November 1879, Edison filed a patent for an electric lamp with a carbon filament and keep testing to find the perfect filament for his light bulb. The highest melting point of any chemical element, tungsten, was known by Edison to be an excellent material for light bulb filaments, but the machinery needed to produce super-fine tungsten wire was not available in the late 19th century. Tungsten is still the primary material used in incandescent bulb filaments today.

Early candles were made in China in about 200 BC from whale fat and rice paper wick. They were made from other materials through time, like tallow, spermaceti, colza oil and beeswax until the discovery of paraffin wax which made production of candles cheap and affordable to everyone. Wick was also improved over time that made from paper, cotton, hemp and flax with different times and ways of burning. Although not a major light source now, candles are still here as decorative items and a light source in emergency situations. They are used for celebrations such as birthdays, religious rituals, for making atmosphere and as a decor.

Illumination has been improved throughout the times. Even now, the lighting device we used today are still being improved. From the illumination of the sun to the time when human can control fire for providing illumination which changed human history, we have been improving the lighting source for a better efficiency and sense. From the invention of candle, gas lamp, electric carbon arc lamp, kerosene lamp, light bulb, fluorescent lamp to LED lamp, the improvement of illumination shows the necessity of light in human lives.

There are various types of lighting apparatuses. When cost and light efficiency of LED have shown great effect compared with traditional lighting devices, people look for even better light output. It is important to recognize factors that can bring more satisfaction and light quality and flexibility.

Light bulbs are widely used in various places. With Edison caps, it is easy to install light bulbs to Edison sockets.

To make the manufacturing cost even lower, it is beneficial to design a flexible design for factory to more easily assembly a light bulb device.

SUMMARY

In some embodiments, a lighting apparatus includes a light source plate, a LED module, a first wire, a second wire and a terminal housing.

The light source plate has a first connector and a second connector.

The LED module is mounted on a first side of the light source plate to be electrically connected to the first connector and the second connector.

The first wire passes through a first passage on the light source plate from a second side of the light source plate to the first side of the light source plate to engage the first connector.

The second wire passes through a second passage of the light source plate from the second side of the light source plate to the first side of the light source plate to engage the second connector.

The terminal housing encloses the first wire and the second wire. The terminal housing receives an external power source to be converted as a driving current supplied to the LED module.

In some embodiments, the lighting apparatus may also include a bulb shell.

The bulb shell is attached to the terminal housing.

The terminal housing has an Edison cap.

The Edison cap routes the external power source to the first wire and the second wire.

In some embodiments, a first top end of the first wire is fixed to the first connector by deforming the first connector to clip the first wire.

A second top end of the second wire is fixed to the second connector by deforming the second connector to clip the second wire.

In some embodiments, the first connector and the second connector are metal tubes with portions protruding above the light source plate.

In some embodiments, the metal tubes are squeezed to deform for fixing the first wire and the second wire to the first connector and the second connector.

In some embodiments, the first connector and the second connector are placed at a peripheral area of the light source plate.

In some embodiments, an exterior side of the first connector has a reflector layer for reflecting a light of the LED module.

In some embodiments, a driver is disposed on the light source plate for converting the external power received from the first wire and the second wire to the driving current.

In some embodiments, a circuit of the driver is placed on the second side of the light source plate.

In some embodiments, an antenna of the driver is placed on the first side of the light source plate.

In some embodiments, the terminal housing has a neck portion, the neck portion has a top edge with a clip for buckling the bulb shell.

In some embodiments, the lighting apparatus may also include a heat dissipation ring enclosed by the neck portion of the terminal housing.

In some embodiments, the first wire has a first end part.

The neck portion has a first tube for guiding the first end part of the first wire to electrically contact a first electrode of the Edison cap.

In some embodiments, the first tube is a metal piece electrically connected to the first electrode of the Edison cap.

In some embodiments, the first end part is bent to engage the first tube.

In some embodiments, the second wire has a second end part.

The neck portion has a second tube for guiding the second end part of the second wire to electrically contact a second electrode of the Edison cap.

In some embodiments, the second tube is a metal piece electrically connected to the second electrode of the Edison cap.

In some embodiments, the first wire has a fusible resistor for breaking power supply to the light source plate under abnormal condition.

In some embodiments, the bulb shell has a diffusion layer attached on an internal side of the bulb shell.

In some embodiments, the diffusion layer has a first thickness larger on a top portion than a second thickness of a lateral portion.

DETAILED DESCRIPTION

Figure 6:
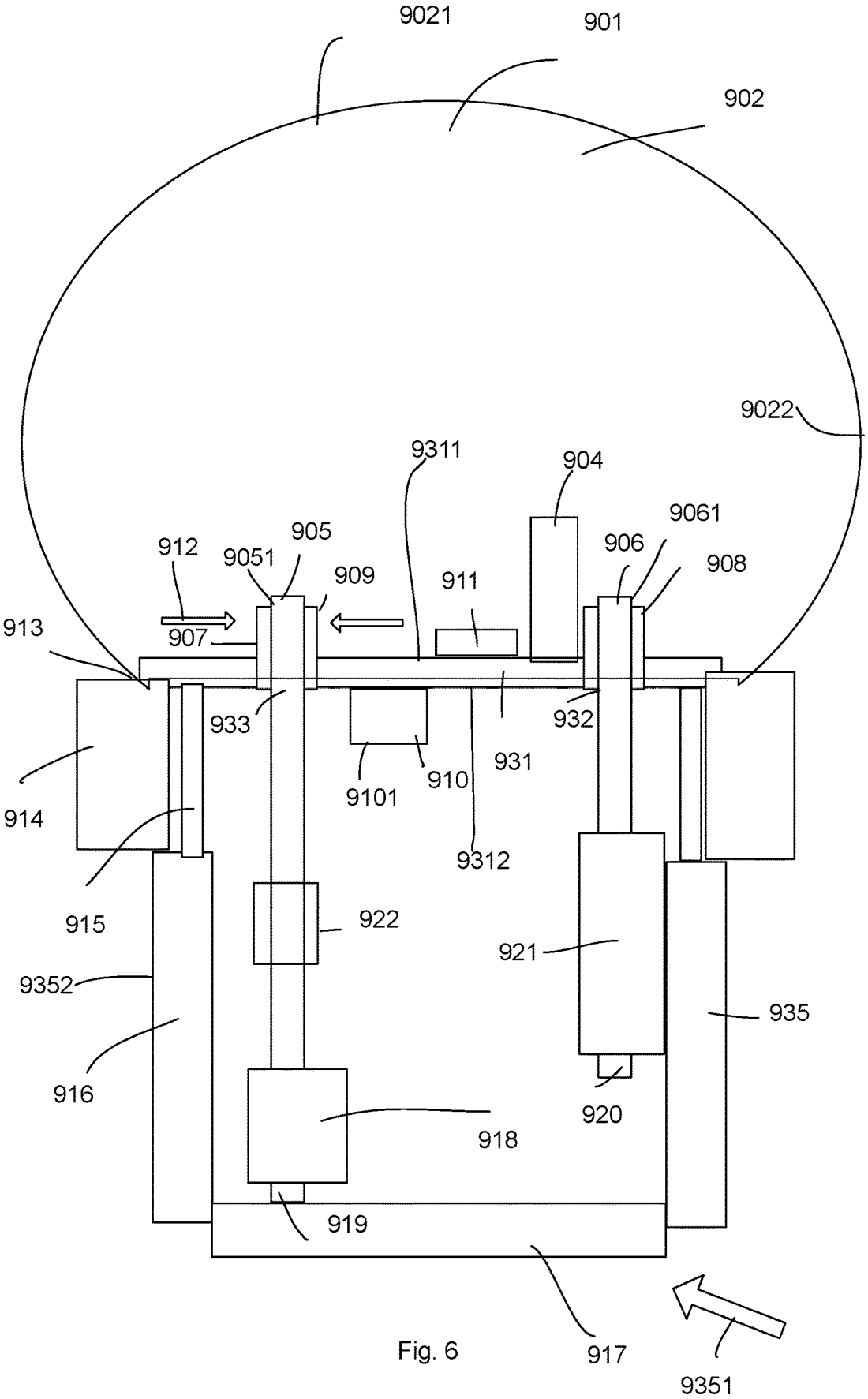
FIG. 6 illustrates another lighting apparatus.

Please refer to FIG. 6, which illustrates a lighting apparatus. Please be noted that the example in FIG. 6 is a light bulb device, but the same invention concept is extended to other light device types, e.g. downlight devices, spot light devices, and others.

The lighting apparatus includes a light source plate 931, a LED module 911, a first wire 905, a second wire 906 and a terminal housing 935.

The light source plate 931 has a first connector 907 and a second connector 908.

The LED module 911 is mounted on a first side 9311 of the light source plate 931 to be electrically connected to the first connector 905 and the second connector 908.

The first wire 905 passes through a first passage 933 on the light source plate 931 from a second side 9312 of the light source plate 931 to the first side 9311 of the light source plate 931 to engage the first connector 905.

The second wire 906 passes through a second passage 932 of the light source plate 932 from the second side 9312 of the light source plate 931 to the first side 9311 of the light source plate 931 to engage the second connector 908.

The terminal housing 935 encloses the first wire 905 and the second wire 906. The terminal housing 935 receives an external power source 9351 to be converted as a driving current supplied to the LED module 911.

In some embodiments, the lighting apparatus may also include a bulb shell 901.

The bulb shell 901 is attached to the terminal housing 935.

The terminal housing 935 has an Edison cap 9352.

The Edison cap 9352 routes the external power source 9351 to the first wire 905 and the second wire 906.

In some embodiments, a first top end 9051 of the first wire 905 is fixed to the first connector 905 by deforming the first connector 907 to clip the first wire 905. For example, a clip is used for squeeze the first connector 907 to deform so as to fix the first wire.

A second top end 9061 of the second wire 906 is fixed to the second connector 908 by deforming the second connector 908 to clip the second wire 906.

In some embodiments, the first connector 907 and the second connector 908 are metal tubes with portions protruding above the light source plate 931.

In some embodiments, the metal tubes are squeezed to deform for fixing the first wire and the second wire to the first connector and the second connector.

In some embodiments, the first connector and the second connector are placed at a peripheral area of the light source plate, as illustrated in FIG. 6.

In some embodiments, an exterior side of the first connector 907 has a reflector layer 909 for reflecting a light of the LED module so as to enhance light efficiency.

In some embodiments, a driver 910 is disposed on the light source plate 931 for converting the external power 9351 received from the first wire 905 and the second wire 906 to the driving current.

In some embodiments, a circuit 9101 of the driver 910 is placed on the second side 9312 of the light source plate 931.

In some embodiments, an antenna 904 of the driver 910 is placed on the first side 9311 of the light source plate 931.

In some embodiments, the terminal housing 935 has a neck portion 914. The neck portion 914 has a top edge with a clip 913 for buckling the bulb shell 901.

In some embodiments, the lighting apparatus may also include a heat dissipation ring 915 enclosed by the neck portion 914 of the terminal housing 935.

In some embodiments, the first wire 905 has a first end part 9051.

The neck portion 914 has a first tube 918 for guiding the first end part 919 of the first wire 905 to electrically contact a first electrode 917 of the Edison cap.

In some embodiments, the first tube 918 is a metal piece electrically connected to the first electrode 917 of the Edison cap.

In some embodiments, the first end part 919 is bent to engage the first tube 918.

In some embodiments, the second wire 906 has a second end part 920.

The neck portion 914 has a second tube 921 for guiding the second end part 920 of the second wire 906 to electrically contact a second electrode 916 of the Edison cap.

In some embodiments, the second tube 920 is a metal piece electrically connected to the second electrode 916 of the Edison cap.

In some embodiments, the first wire has a fuss resistor 922 for breaking power supply to the light source plate under abnormal condition.

In some embodiments, the bulb shell 901 has a diffusion layer 902 attached on an internal side of the bulb shell 901.

In some embodiments, the diffusion layer has a first thickness larger on a top portion 9021 than a second thickness of a lateral portion 9022.

Figure 1:
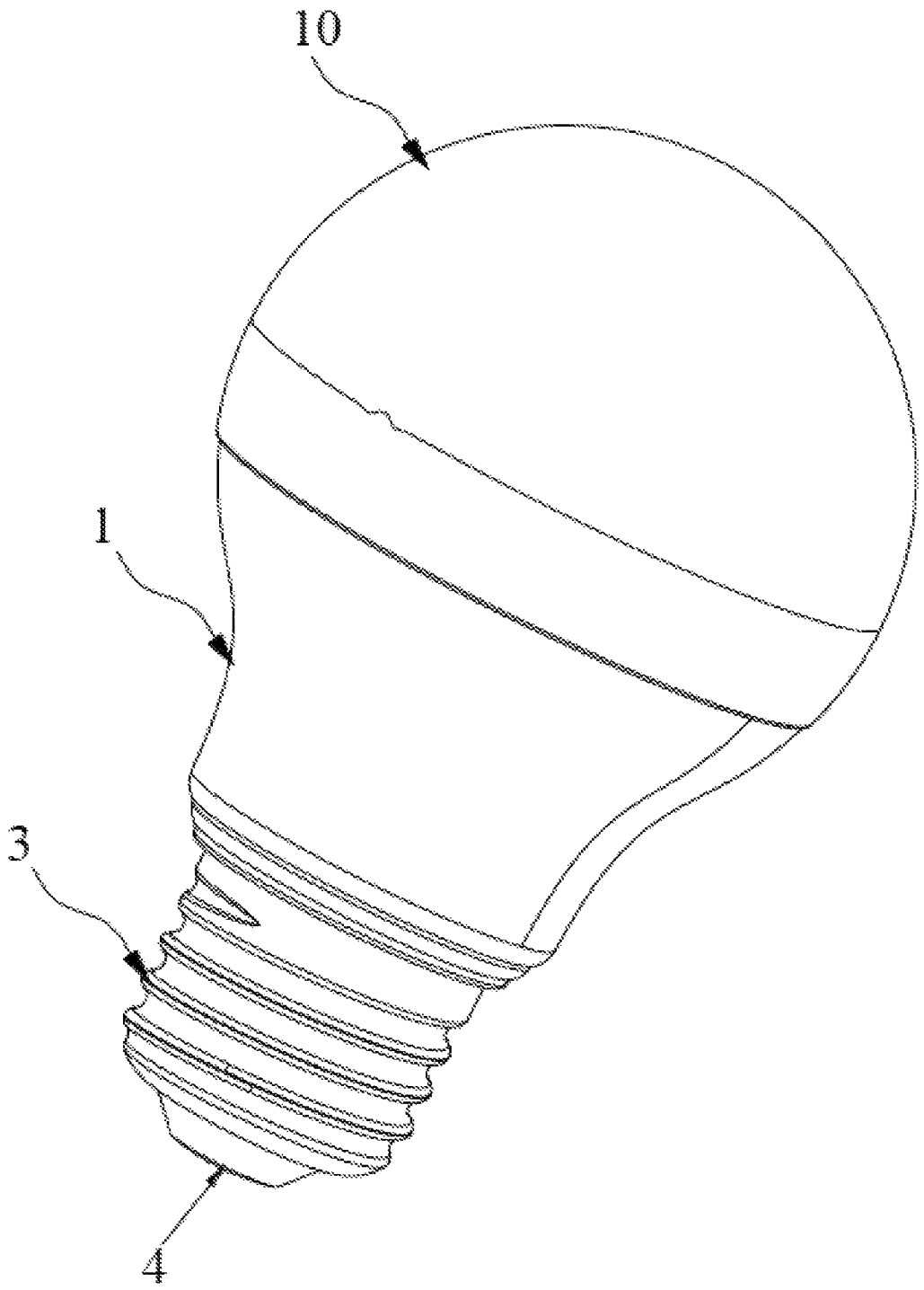
FIG. 1 illustrates a light bulb device example.

Please refer to FIG. 1, which shows a light bulb device example.

In FIG. 1, the light bulb device has a bulb shell 10 fixed to a terminal housing 1.

The terminal housing 1 has an Edison cap 3 that has two electrodes while one electrode 4 is at a bottom of the Edison cap 3.

Figure 2:
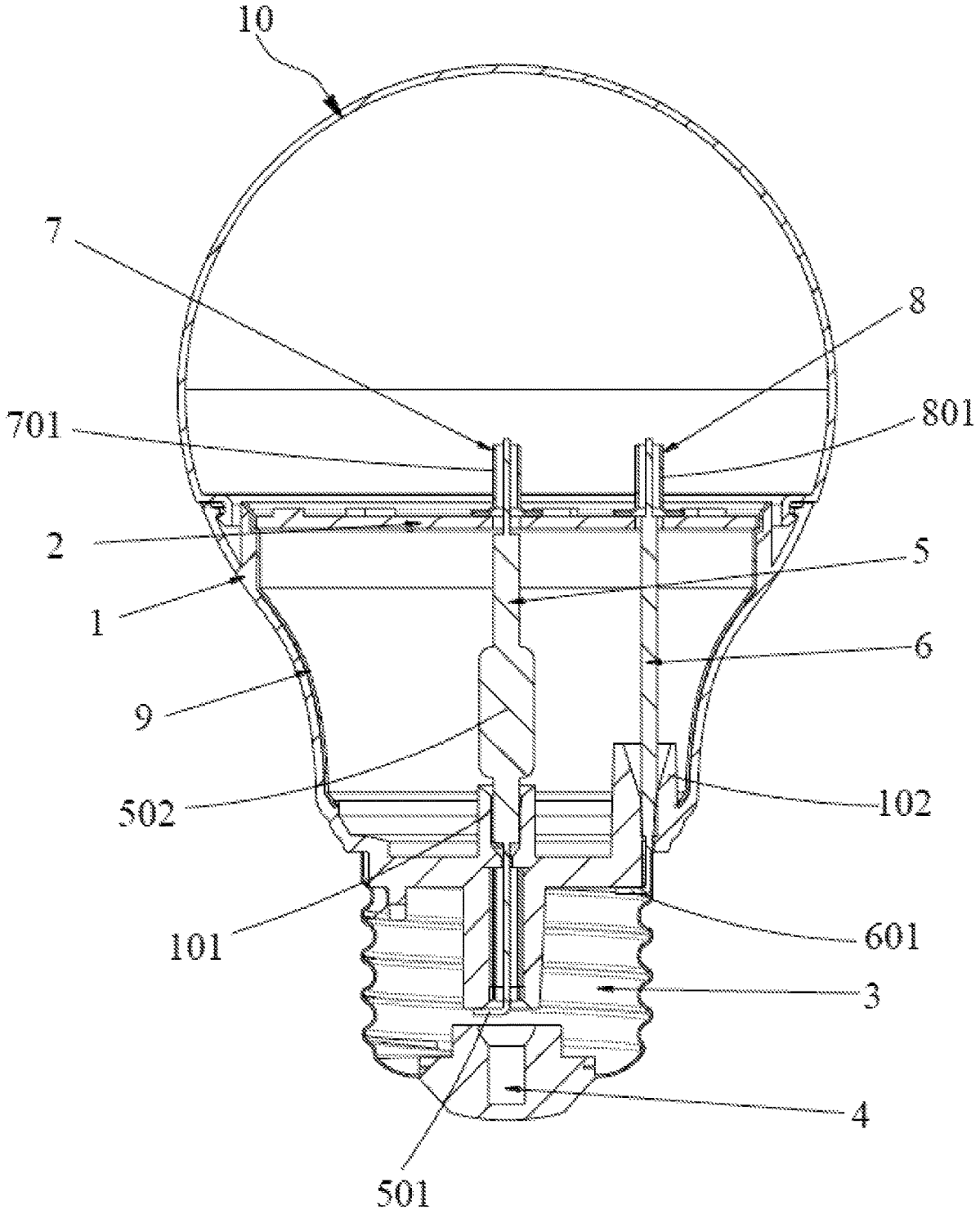
FIG. 2 illustrates a cross-sectional view of the example in FIG. 1.

Please refer to FIG. 2, which shows a cross-sectional view of the example in FIG. 1.

In addition to the components mentioned above, the light bulb device has a first wire 5, a second wire 6, a fusible resistor 502 on the first wire 5, a first tube 101 and a second tube 102.

The first wire 5 has a first end part 501 bent to contact the electrode 4 of the Edison cap 3. The second wire 6 has a second end part 601 contacting the second tube 102 connected to a second electrode of the Edison cap 3.

The terminal housing 1 has a neck portion enclosing a heat dissipation ring 9. The light source plate 2 is placed on the terminal housing 1. A first connector 7 and a second connector 8 are disposed above the light source plate 2 for receiving the first wire 5 and the second wire 6.

The first connector 7 has a rivet tube 701. The second connector 8 has a rivet tube 801. After the first wire 5 and the second wire 6 are inserted into the rivet tubes 701, 801 respectively, the rivet tubes 701, 801 may be squeezed to fix the first wire 5 and the second wire 6.

Figure 3:
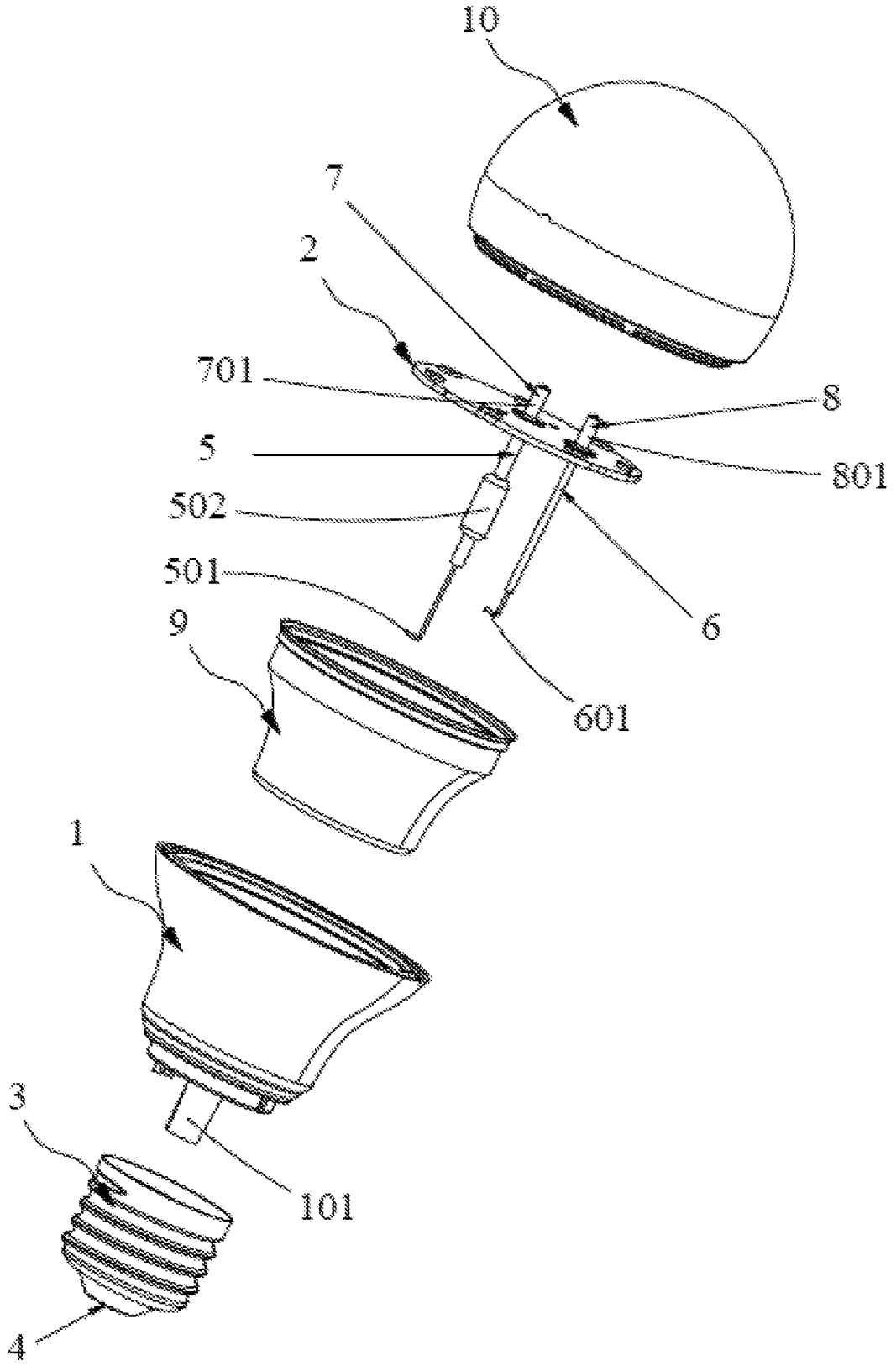
FIG. 3 illustrates an exploded view of the light bulb device in FIG. 1.

Please refer to FIG. 3, which shows an exploded view of the example in FIG. 2.

FIG. 3 provides a more detailed view on each component in this example.

Figure 4:
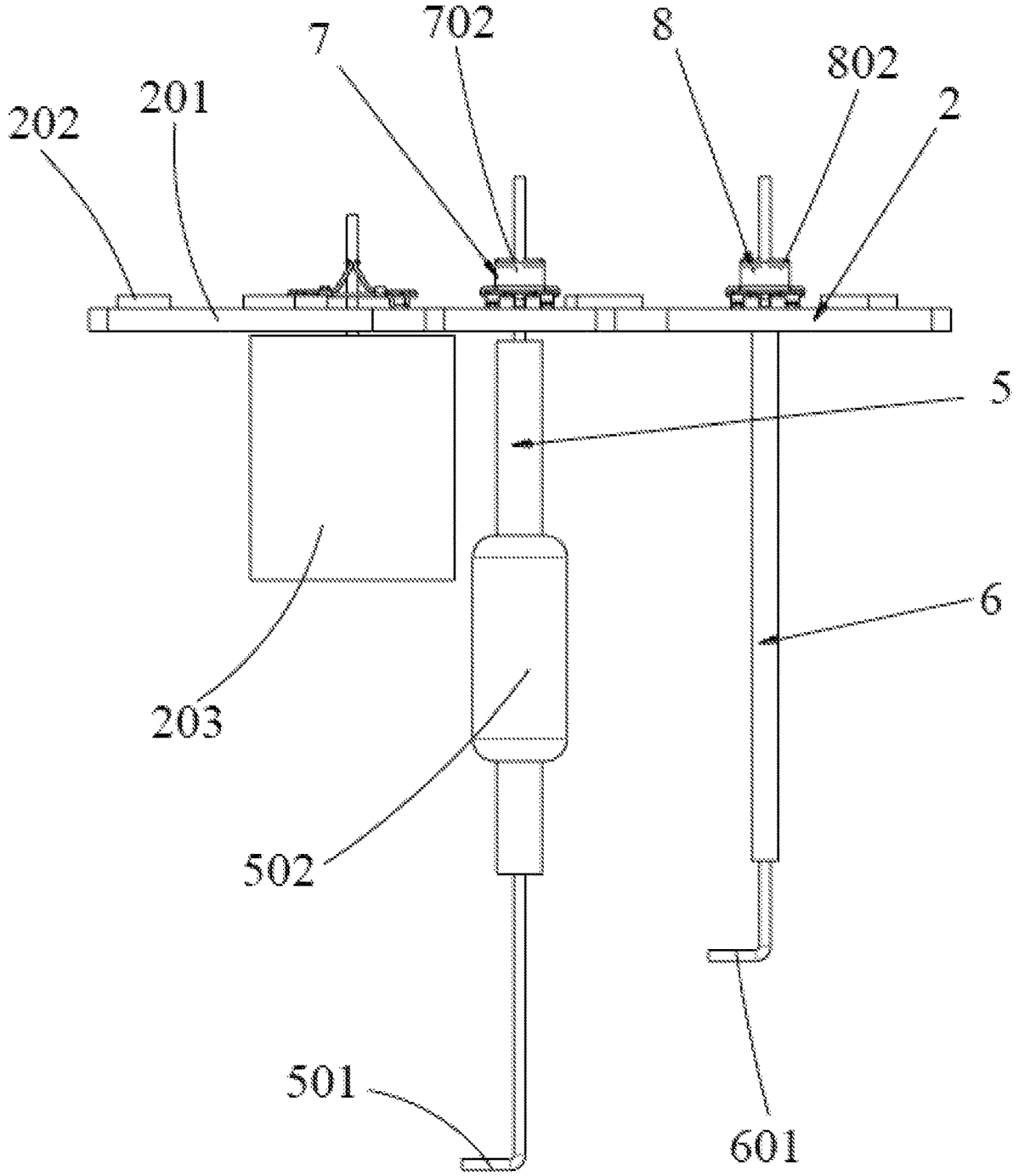
FIG. 4 illustrates components of a first example.

FIG. 4 shows an example that the driver has a component 203 disposed on a second side of the light source plate 201. The LED module 202 is placed on a first side of the light source plate 201. Other components with the same reference numerals are already mentioned above.

Figure 5:
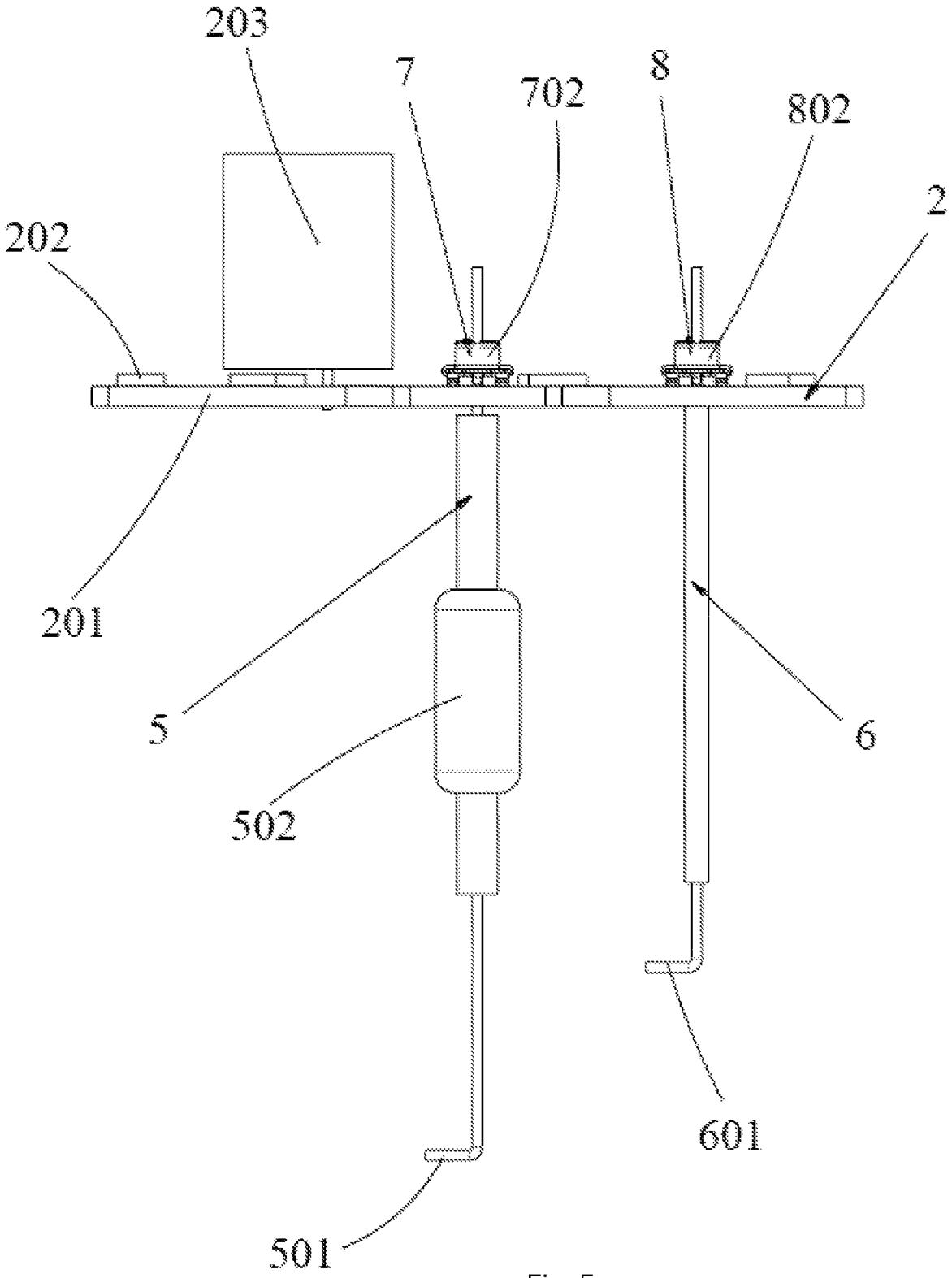
FIG. 5 illustrates components of a second example.

FIG. 5 shows an alternative example in which the component 203 of the driver is disposed on the first side of the light source plate 201.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A lighting apparatus comprising:

a light source plate having a first connector and a second connector;

a LED module mounted on a first side of the light source plate to be electrically connected to the first connector and the second connector;

a first wire passing through a first passage on the light source plate from a second side of the light source plate to the first side of the light source plate to engage the first connector;

a second wire passing through a second passage of the light source plate from the second side of the light source plate to the first side of the light source plate to engage the second connector;

a terminal housing for enclosing the first wire and the second wire and for receiving an external power source to be converted as a driving current supplied to the LED module; and a bulb shell, wherein the bulb shell is attached to the terminal housing, the terminal housing has an Edison cap, the Edison cap routes the external power source to the first wire and the second wire, wherein an exterior side of the first connector has a reflector layer for reflecting a light of the LED module, wherein the first wire has a fusible resistor for breaking power supply to the light source plate under abnormal condition.

2. The lighting apparatus of claim 1, wherein a first top end of the first wire is fixed to the first connector by deforming the first connector to clip the first wire, a second top end of the second wire is fixed to the second connector by deforming the second connector to clip the second wire.

3. The lighting apparatus of claim 2, wherein the first connector and the second connector are metal tubes with portions protruding above the light source plate.

4. The lighting apparatus of claim 3, wherein the metal tubes are squeezed to deform for fixing the first wire and the second wire to the first connector and the second connector.

5. The lighting apparatus of claim 2, wherein the first connector and the second connector are placed at a peripheral area of the light source plate.

6. The lighting apparatus of claim 1, wherein a driver is disposed on the light source plate for converting the external power received from the first wire and the second wire to the driving current.

7. The lighting apparatus of claim 6, wherein a circuit of the driver is placed on the second side of the light source plate.

8. The lighting apparatus of claim 6, wherein an antenna of the driver is placed on the first side of the light source plate.

9. The lighting apparatus of claim 1, wherein the terminal housing has a neck portion, the neck portion has a top edge with a clip for buckling the bulb shell.

10. The lighting apparatus of claim 9, further comprising a heat dissipation ring enclosed by the neck portion of the terminal housing.

11. The lighting apparatus of claim 9, wherein the first wire has a first end part, the neck portion has a first tube for guiding the first end part of the first wire to electrically contact a first electrode of the Edison cap.

12. The lighting apparatus of claim 11, wherein the first tube is a metal piece electrically connected to the first electrode of the Edison cap.

13. The lighting apparatus of claim 12, wherein the first end part is bent to engage the first tube.

14. The lighting apparatus of claim 9, wherein the second wire has a second end part, the neck portion has a second tube for guiding the second end part of the second wire to electrically contact a second electrode of the Edison cap.

15. The lighting apparatus of claim 14, wherein the second tube is a metal piece electrically connected to the second electrode of the Edison cap.

16. The lighting apparatus of claim 1, wherein the bulb shell has a diffusion layer attached on an internal side of the bulb shell.

17. The lighting apparatus of claim 16, wherein the diffusion layer has a first thickness larger on a top portion than a second thickness of a lateral portion.

* * * * *